US006726068B2

(12) United States Patent
Miller

(10) Patent No.: US 6,726,068 B2
(45) Date of Patent: Apr. 27, 2004

(54) ELASTOMERIC THIMBLE

(76) Inventor: Dennis J. Miller, 4190 Wilkinson Rd., Gaylord, MI (US) 49735

( * ) Notice: Subject to any disclaimer, the term of this patent is extended or adjusted under 35 U.S.C. 154(b) by 0 days.

(21) Appl. No.: 10/113,539

(22) Filed: Mar. 29, 2002

(65) Prior Publication Data

US 2002/0145017 A1 Oct. 10, 2002

Related U.S. Application Data

(60) Provisional application No. 60/282,396, filed on Apr. 9, 2001.

(51) Int. Cl.[7] ..... D05B 91/04
(52) U.S. Cl. ..... 223/101
(58) Field of Search ..... 223/101; 602/63, 602/61; 2/21, 168

(56) References Cited

U.S. PATENT DOCUMENTS

| | | | | | |
|---|---|---|---|---|---|
| 837,896 | A | | 12/1906 | Bourne | |
| 2,207,672 | A | | 7/1940 | Levey | |
| 3,348,541 | A | * | 10/1967 | Loebeck | 602/58 |
| 3,531,029 | A | | 9/1970 | Lee | |
| 3,728,736 | A | * | 4/1973 | Pugh | 2/21 |
| 4,127,222 | A | * | 11/1978 | Adams | 223/101 |
| 4,239,134 | A | | 12/1980 | Joy | |
| D270,966 | S | | 10/1983 | Lynn | |
| 4,888,829 | A | * | 12/1989 | Kleinerman et al. | 2/167 |
| 4,944,437 | A | | 7/1990 | Calvert | |
| 6,098,854 | A | | 8/2000 | Apple | |
| 6,409,059 | B1 | * | 6/2002 | Calvert | 223/101 |

OTHER PUBLICATIONS

Roxanne McElroy, That Perfect Sitch; The Secrets of Fine Hand Quilting, 1998, The Quilt Digest Press, Chicago, IL. pp. 35, 36, 37, 39, 40, 41.

* cited by examiner

*Primary Examiner*—John J. Calvert
*Assistant Examiner*—James G Smith

(57) ABSTRACT

A finger protective device constructed from elastomeric materials. A working surface covers the fleshy portion of a finger and is of sufficient strength and hardness to avoid penetration by a needle, yet elastomeric to accommodate large variations in shape. The working surface may be interrupted by ribs or protrusions to prevent needle slippage. A compliant member surrounds the remainder of the finger and is softer in order to comply with the majority of finger shape variations. The thimble thus formed is designed to conform to the shape of a finger and remain adhered by frictional means to provide comfortable protection.

1 Claim, 3 Drawing Sheets

ELASTOMERIC THIMBLE

CROSS-REFERENCE TO RELATED APPLICATIONS

This application claims priority of U.S. Provisional Patent Application Ser. No. 60/282,396, which was filed on Apr. 9, 2001.

BACKGROUND OF THE INVENTION

This invention relates generally to fingertip protectors and thimbles and specifically to an elastomeric thimble designed for enhanced comfort and control of a sewing needle.

It is well known in the art that hand sewing can require a considerable amount of repetitive force to be applied to a sewing needle by a finger in order to stitch fabric. Finger protective devices and thimbles have long been used for their ability to prevent injury to the fingers during the stitching operation and the prior art contains numerous examples. Among the earliest examples of such thimbles are of a somewhat truncated conical shaped metal cap designed to slip over and be adhered to the end of the sewing digit by frictional means. The top and sides of the thimble are dimpled to receive the end of the needle and prevent slippage as force is applied. Such thimbles are in use even today.

The lack of comfort in rigid thimbles has long been a concern as evidenced by Pat. No. 837,896 dated Dec. 4, 1906 to Bourne. Therein is described a custom thimble shaped by means of forming a hard material in a cast taken from the user's finger. Naturally such a thimble would be prohibitively expensive and impractical to produce on a large scale basis.

With advances in plastic technology, the conical shaped thimbles have been successfully molded from rigid plastics as described in Pat. No. D270,966 dated Oct. 18, 1983 to Lynn. The design has been further altered to provide an opening for the fingernail. However, the rigidity of these thimbles can still cause pressure points on the finger with the additional disadvantage of premature wear of the plastic material therein utilized.

The comfort issue with truncated conical metal thimbles is addressed by Lee in U.S. Pat. No. 3,531,029, dated Sep. 29, 1970. The wraparound thimble therein described deals mainly with comfort as affected by thimble size. It does not adequately solve the problem of mismatch in shape between a finger and a thimble.

U.S. Pat. No. 4,239,134 dated Jul. 16, 1980 to Joy describes a flexible material to conform to the finger, with a rigid insert or inserts to engage a needle. These thimbles are expensive to manufacture and the material covering the reinforcing plate wears through prematurely, causing the needle to slip against the plate and even injure the finger through the fingernail opening. The protective plate is described as being oval shaped, greatly restricting manufacturing and design considerations.

Similarly, U.S. Pat. No. 4,127,222 dated Nov. 28, 1978 to Adams describes an elastomeric thimble for comfort with a head portion at least twice the thickness of the body. The head totally encapsulates the tip of the finger to protect it from needle contact. For the head to be puncture resistant it will also be too hard to conform to finger shape variations from user to user, generally being too loose or producing pressure points on the finger tip. The additional reinforcement is described as being interposed in the forward portion of the head, thus increasing design complexity and manufacturing cost.

U.S. Pat. No. 4,944,437, dated Jul. 31, 1990 to Calvert sets forth another pliable material thimble with a rigid insert. This thimble is complicated and expensive to manufacture. It also lacks comfort as the reinforcement, being planar, will not conform to the shape of any finger.

In U.S. Pat. No. 6,098,854 dated Aug. 8, 2000, Apple teaches a concept employing an adhesive backed disk. The design suffers from limited contact area and is primarily meant to protect a finger from inadvertent pricks from a needle. It is not conducive to driving a needle through fabric as the needle may slip off the disk and cause injury to the unprotected portion of the finger.

BRIEF SUMMARY OF THE INVENTION

It is a goal of the present invention to overcome the limitations of the prior art, whether manifested in a rigid metal, ceramic, or plastic thimble, a rigidly reinforced flexible protective device, or a self adhering pad.

Accordingly, several objects and advantages of the present invention are:

(a) to provide a finger protective device which effectively protects the finger from injury while applying force to a needle.

(b) to provide a finger protective device which is well suited to various types and techniques of needlework.

(c) to provide a finger protective device which resists wear and abrasion from repeated contact with a needle.

(d) to provide a finger protective device which is flexible enough to conform to irregularities and deviations from the average finger shape, resulting in a comfortable fit.

(e) to provide a finger protective device which is light weight.

f) to provide a finger protective device which is inexpensive to manufacture.

(g) to provide a finger protective device which is aesthetically pleasing.

Further objects and advantages of my invention will become apparent from a consideration of the ensuing drawings and description.

DETAILED DESCRIPTION OF THE INVENTION

Figure 1:
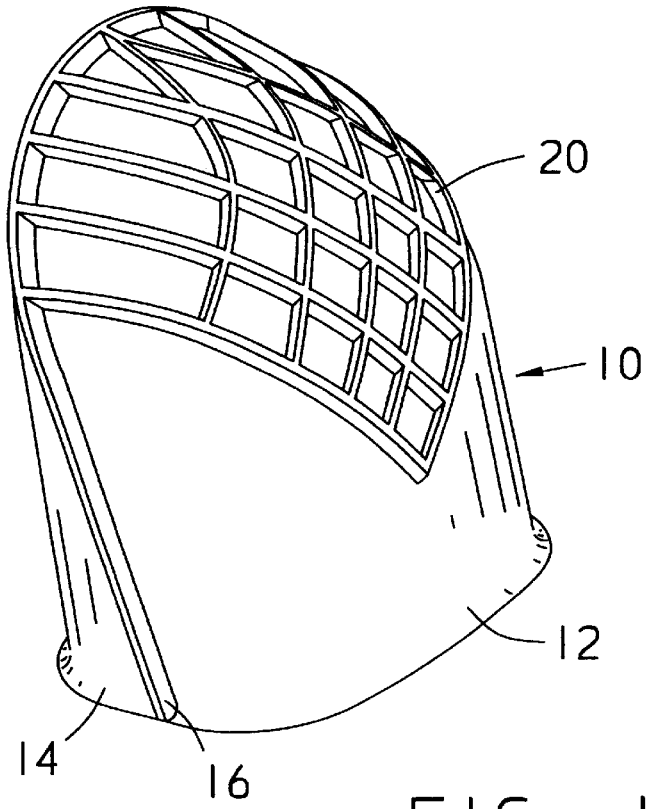
FIG. 1 is a perspective view of a first embodiment of the present invention.

FIG. 1 illustrates one embodiment of the present invention. Thimble 10 is composed of working surface 12 permanently attached to compliant member 14 at joint 16. The two parts form an approximately cylindrical shape with an opening at one end and tapered to closure at the other end. Working surface 12 and compliant member 14 are shown each constituting approximately one half of thimble 10 although they each may vary in size with one being the larger component than the other. The molecular composition of working surface 12 and compliant member 14 should allow them to be mutually attached by any method known in the art, such as welding or adhesive bonding. Joint 16 is kept as small and as smooth as possible to avoid irritating adjacent fingers.

Figure 2:
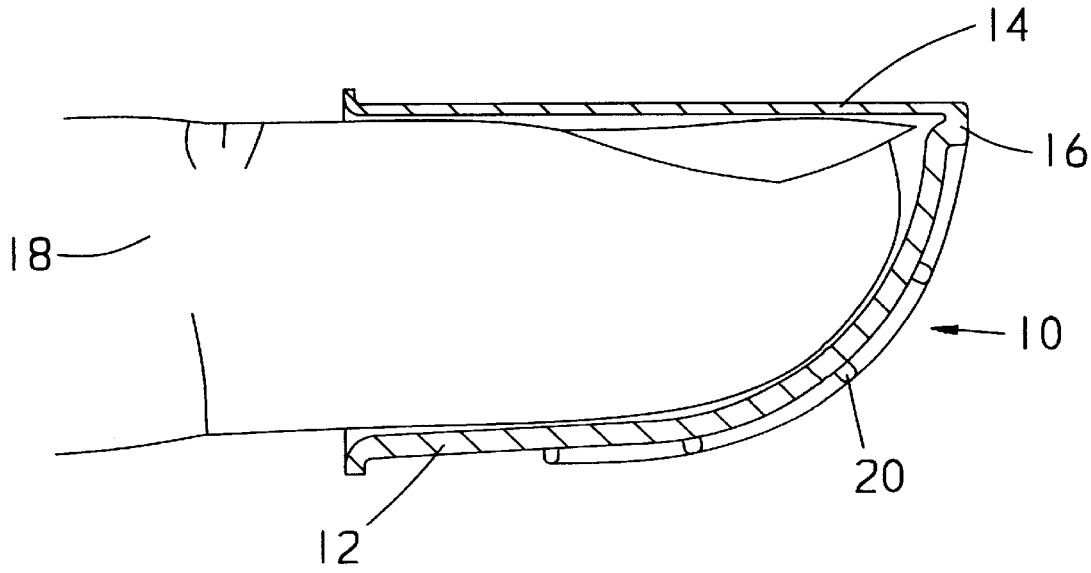
FIG. 2 is sectional view of a thimble on a finger showing the conformable fit due to the elastomeric nature of the material.

FIG. 2 shows the extent that thimble 10 is contoured to the shape of an average finger. Because of its elastomeric nature, thimble 10 will yield to variations of finger 18 from average. Likewise, finger 18 will also naturally comply to the shape of thimble 10 The gentle force generated as thimble 10 and finger 18 mutually conform, each to the other, will cause a frictional force capable of adhering thimble 10 to finger 18.

Working surface 12 is formed from a polymeric material of sufficient thickness, hardness, and strength to avoid penetration in the anticipated application. It is also elastomeric enough to conform to large variations in fit with a wide variety of users. For long service life, it is also abrasion and compression set resistant. Due to advances in polymer science, materials with the molecular structure to meet these design constraints are readily available in various forms.

Working surface 12 constitutes only a portion of thimble 10. It is molded to cover the fleshy part of finger 18 and approximately matches the shape of the average finger. As such, it may be somewhat rigidly formed because the fleshy part of finger 18 will readily conform to minor deviations in shape between the two with little or no discomfort to the user.

Figure 3:
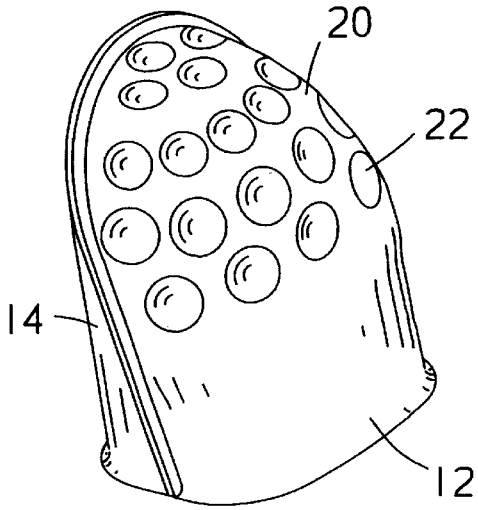
FIG. 3 is a perspective view of the thimble illustrating the pattern of raised ribs in an alternate arrangement.

As shown in FIGS. 1 and 2, working surface 12 may employ numerous ribs 20 to interrupt the area of contact with a sewing needle. Ribs 20 enable thimble 10 to capture the end of a needle and prevent the needle from slipping across working surface 12. Thus the user is provided with a stable platform for applying great force to drive a needle. Ribs 20 can be located in a myriad of aesthetically pleasing arrangements. In FIG. 3 the roots of ribs 20 and their intersection with each other are radiused to the extent that the pockets between ribs 20 are in the form of dimples 22. The dimples may be of any size, even so small as to give working surface 12 the appearance of being stippled or having a rough texture as is common in plastic molding.

Figure 4:
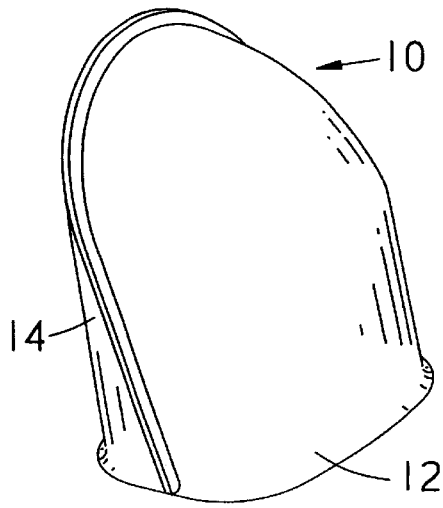
FIG. 4 is a perspective view of an embodiment without ribs.

Working surface 12 may be formed without ribs as shown in FIG. 4. This is useful when using the device as an under thimble in quilt making. In such an application, working surface 12 is thin and flexible enough to feel a needle point protrude from the fabric being stitched, yet strong enough to avoid penetration. The surface is relatively smooth to allow the needle to glance off and return to the fabric for the next stitch.

In applications utilizing a larger diameter needle, working surface 12 may also be designed to be more flexible, while remaining impenetrable to a larger needle head. It is then possible for working surface 12 to sufficiently deform to capture the needle head without the aid of ribs.

Compliant member 14 forms the remainder of thimble 10. It is anticipated to be formed from a material which is generally thinner, more resilient and/or more moisture permeable than working surface 12. In the aforementioned applications where working surface 12 is thin and flexible, however, compliant member 14 and working surface 12 may be the same material.

Figure 5:
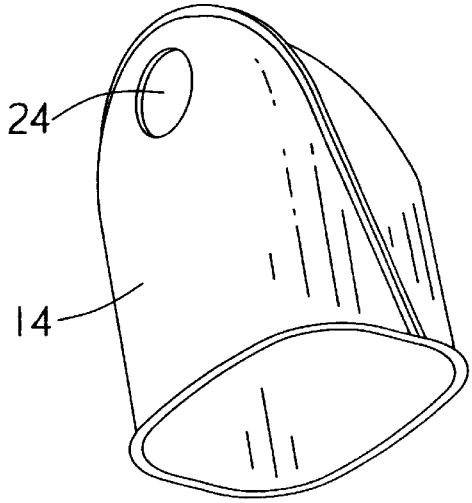
FIG. 5 is a perspective view of an embodiment illustrating the fingernail side of the present invention.

Compliant member 14 should conform easily to various finger shapes, thereby applying a gentle force to maintain the position of thimble 10 on a finger by frictional means. It is also soft enough to avoid irritating the more sensitive skin surrounding the fingernail. However, compliant member 14 should still able to protect the finger from extraneous picks and stabs. FIG. 5 shows that compliant member 14 may also have one or more holes 24 to discourage excessive moisture build up during use. Compliant member 14 substantially covers the user's fingernail and, therefore, is similarly shaped.

Figure 6:
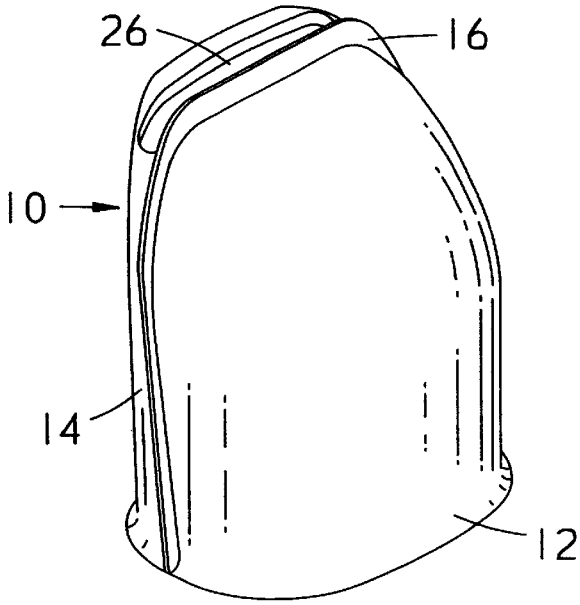
FIG. 6 is an perspective view of the thimble with a slotted fingernail opening.

Joint 16 between working surface 12 and compliant member 14 at the closed end of the cylindrical shape of thimble 10 is positioned where it will provide adequate clearance for the fingernail of most users, as shown in FIG. 2. As an additional embodiment, FIG. 6 illustrates slot 26 which may be at or near joint 16 at the closed end of thimble 10. Slot 26 will accommodate longer fingernails which may protrude substantially beyond the end of the finger.

Figure 7:
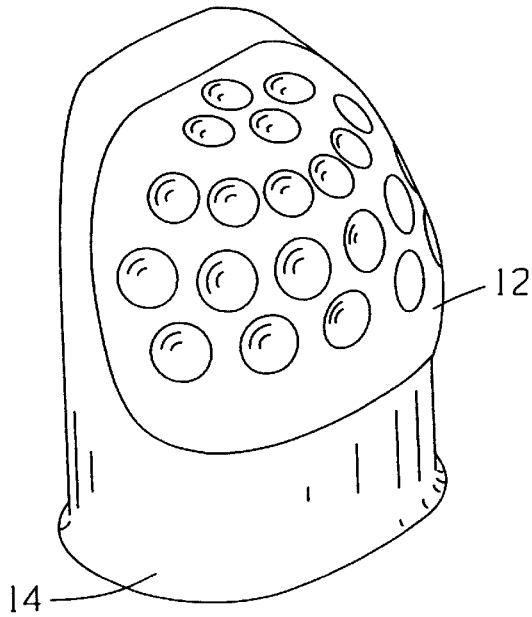
FIG. 7 is a perspective view of the thimble illustrating an alternate method of assembly.

FIG. 7 illustrates an embodiment of the invention in which compliant member 14 is completely tubular in form and covers the entire tip of the finger. Working surface 12 is a separate piece adhered to the surface of compliant member 14 in the area determined to make contact with the needle. Working surface 12 and compliant member 14 perform the same functions as previously described and this embodiment provides for an alternate method of manufacture.

Accordingly, the reader will see that the described thimble is simple yet effective in its ability to provide comfortable protection to the user. This invention has potential for application in any instance where finger protection is desired. Its use should not be considered to be limited to needlework.

Although the described figures illustrate given shapes for the components, it is recognized that those skilled in the art are capable of producing further embodiments utilizing like arrangements, materials and principles of design. Several embodiments of the components of this invention have been shown, but the combinations thereof are by no means exhausted in this disclosure. Further embodiments may be created by additional combinations of the embodiments herein described and shown. Such additional arrangements can be construed as modifications useful under various circumstances and can all be considered useful embodiments of the disclosed invention. Thus the scope of the invention should be determined by the appended claims and their legal equivalents, rather than by the examples given.

I claim:

1. A thimble comprising:

a) a thin film elastomeric compliant member, sized and positioned to substantially cover the fingernail side of a finger, b) an elastomeric working surface of constant cross section, substantially harder and thicker than said compliant member, contoured, sized and positioned to substantially cover the fingerprint side of a finger, whereby said working surface and said compliant member are joined together, thereby forming a closed tube shape for the purpose of protecting a finger, with said working surface situated to directly engage a needle.

* * * * *